US009337594B2

(12) United States Patent
Brødsgaard

(10) Patent No.: US 9,337,594 B2
(45) Date of Patent: May 10, 2016

(54) HERMAPHRODITIC ELECTRICAL CONNECTOR DEVICE WITH ADDITIONAL CONTACT ELEMENTS

(75) Inventor: Brian Brødsgaard, Solrød Strand (DK)

(73) Assignee: GN Netcom A/S (DK)

( * ) Notice: Subject to any disclaimer, the term of this patent is extended or adjusted under 35 U.S.C. 154(b) by 14 days.

(21) Appl. No.: 14/119,868

(22) PCT Filed: May 24, 2012

(86) PCT No.: PCT/EP2012/059659
§ 371 (c)(1),
(2), (4) Date: Nov. 7, 2014

(87) PCT Pub. No.: WO2012/160123
PCT Pub. Date: Nov. 29, 2012

(65) Prior Publication Data

US 2015/0079829 A1 Mar. 19, 2015

(30) Foreign Application Priority Data

May 26, 2011 (DK) ..... 2011 00403

(51) Int. Cl.
*H01R 24/84* (2011.01)
*H01R 13/66* (2006.01)
*H01R 107/00* (2006.01)

(52) U.S. Cl.
CPC ..... *H01R 24/84* (2013.01); *H01R 13/66* (2013.01); *H01R 23/27* (2013.01); *H01R 2107/00* (2013.01); *H01R 2201/16* (2013.01)

(58) Field of Classification Search
CPC ..... H01R 13/28; H01R 13/66; H01R 24/84; H01R 23/02; H01R 23/27; H01R 2105/00; H01R 2107/00
USPC ..... 439/284, 290, 699.1, 717, 721, 723
See application file for complete search history.

(56) References Cited

U.S. PATENT DOCUMENTS

| | | | | |
|---|---|---|---|---|
| 3,178,669 A | 4/1965 | Roberts | | |
| 3,638,164 A * | 1/1972 | Glance | ..... | H01R 13/28 439/284 |
| 7,955,109 B2 * | 6/2011 | Toner | ..... | H01R 23/27 439/284 |

FOREIGN PATENT DOCUMENTS

| | | | | |
|---|---|---|---|---|
| DE | 2900700 | 7/1980 | | |
| GB | 2039421 A * | 8/1980 | ..... | H01R 13/28 |
| JP | 7161415 | 6/1995 | | |
| WO | 00/49684 | 8/2000 | | |

OTHER PUBLICATIONS

International Search and Written Opinion for PCT Application No. PCT/EP/2012/059659 dated Jul. 13, 2012.

* cited by examiner

*Primary Examiner* — Amy Cohen Johnson
*Assistant Examiner* — Oscar C Jimenez
(74) *Attorney, Agent, or Firm* — Altera Law Group, LLC

(57) ABSTRACT

An electrical connector device (1), which extends along a longitudinal axis (X) and having an interface part (2) comprising a first set (3) of electrical contact elements (3*a*, 3*b*, 3*c*, 3*d*) arranged along a first line (L1), which is orthogonal to the longitudinal axis (X). The connector device (1) comprises mechanical engagement elements (17, 18, 19) being shaped such that the electrical connector device (1) can be electrically and mechanically connected with an identical connector device (1) when they are aligned along the longitudinal axis (X) and one of them rotated 180 degrees about a transversal axis (Y) parallel with the first line (L1). The interface part (2) comprises a second set (4) of electrical contact elements (4*a*, 4*b*, 4*c*, 4*d*) and a third set (5) of electrical contact elements (5*a*, 5*b*, 5*c*, 5*d*). The second and third sets (4, 5) are symmetrically arranged on opposite sides of the first line (L1) in a first plane (P1) through the first line (L1), such that for each contact element (4*a*, 4*b*, 4*c*, 4*d*) of the second set (4) there is a corresponding contact element (5*a*, 5*b*, 5*c*, 5*d*) of the third set (5), which is arranged with equal distance to the first line (L1). Each contact element (4*a*, 4*b*, 4*c*, 4*d*) of the second (4) set is electrically connected to its corresponding contact element (5*a*, 5*b*, 5*c*, 5*d*) of the third set (5).

15 Claims, 7 Drawing Sheets

HERMAPHRODITIC ELECTRICAL CONNECTOR DEVICE WITH ADDITIONAL CONTACT ELEMENTS

TECHNICAL FIELD

The invention relates to an electrical connector device, which extends along a longitudinal axis and having an interface part comprising a first set of electrical contact elements arranged along a first line, which is orthogonal to the longitudinal axis, and mechanical engagement elements being shaped such that the electrical connector device can be electrically and mechanically connected with an identical connector device when they are aligned along the longitudinal axis and one of them rotated 180 degrees about a transversal axis parallel with the first line.

BACKGROUND ART

A connector device of the above-mentioned art is often referred to as a genderless or hermaphroditic connector device. The contacts of such electrical connector devices are mounted into identical fittings, which can freely mate with any other, without regard for gender. A well-known connecting device of the above mentioned type is the "IBM data connector", which is sometimes called IDC. It was developed for the data network technology named "Token Ring". Headsets used in contact centres and offices are often provided with a so-called "quick disconnect" connector, which is a genderless electric connector used for fast disconnecting and connecting of a headset to a telephone or telephone amplifier. An example of such a connector is disclosed in U.S. Pat. No. 5,259,780. Jabra® markets a broad range of corded headsets for contact centres and offices, which are provided with a "Jabra QD plug". This plug is a four pole genderless plug, which is suitable for telephone headsets.

DISCLOSURE OF INVENTION

The object of the invention is to provide a genderless electrical connecting device, which has more poles but is backward compatible. The connecting device according to the invention is characterized in that the interface part comprises a second set of electrical contact elements and a third set of electrical contact elements, which second and third sets are symmetrically arranged on opposite sides of the first line in a first plane through the first line, such that for each contact element of the second set there is a corresponding contact element of the third set, which is arranged with equal distance to the first line, and wherein each contact element of the second set is electrically connected to its corresponding contact element of the third set. Such a connecting device provides further poles when connected with an identical connecting device but is at the same time backwards compatible with similar connecting devices comprising only the first set of electrical contact elements. When two identical connecting devices according to the invention are connected, the each contact element of the second set of one connecting device will contact a corresponding contact element of the third set of the other connecting device. Thus, the number of poles is increased by the number of contact elements in the second set without increasing the number of contact elements in the first set. If the first, second and third set of contacts each comprise four contact elements, the number of poles will be eight.

According to an embodiment, the second set of contact elements is arranged along a second line and the third set of contact elements is arranged along a third line.

The second line and third line can be straight.

The first, second and third lines can be parallel.

The interface part may comprise a tongue extending along the longitudinal axis and comprising a first side and an opposite second side, wherein the first set of contact elements is arranged on the first side and the second set of contact elements is arranged on the second side.

The interface part may comprise a bottom part, which extends parallel with the tongue, and comprising an inner side facing the tongue and an opposite outer side, wherein the third set of contact elements is arranged on the inner side of the bottom part. This provides a strong mechanical coupling.

According to an embodiment, the bottom part comprises sidewalls extending from the inner side, such that the bottom parts and side walls of two connected connector devices provides an enclosure around the sets or contact elements. Hereby, a closed construction with good isolation against surroundings can be obtained.

The contact elements of each of the second and third sets may be arranged with different distances, f. ex. along half circles. With such a construction, it may be easier to obtain a compact connecting device.

According to an embodiment, the first plane is lying outside a plane perpendicular to the longitudinal axis. In addition, this construction makes it possible to obtain a more compact construction in the direction perpendicular to the longitudinal axis.

The first plane and the longitudinal axis may be lying in the range 0-90 degrees, for example between 30-60 degrees. Hereby a suitable compromise between longitudinal and transversal dimensions of the connecting device can be obtained.

An especially thin connector device can be obtained, if the longitudinal axis is lying in the first plane.

The first set may comprise at least two contact elements.

The first set may comprise at least four contact elements.

Each of the second set and third set may comprise at least two contact elements.

Each of the second set and third set may comprise at least four contact elements.

The contact elements are preferably embodied as discrete islands in the first plane. These discrete islands of the second and third sets are interconnected inside the connector device.

The first set may comprise at least four contact elements. In addition, the second and third sets each comprise at least four contact elements.

The contact elements of each of the second and third sets may be arranged with different distances.

The invention is also relating to an electrical connecting system comprising a two separable second cable parts, where each cable part at its end is provided with an electrical connector device, which extends along a longitudinal axis and having an interface part comprising a first set of electrical contact elements arranged along a first line, which is orthogonal to the longitudinal axis, and mechanical engagement elements being shaped such that the electrical connector device can be electrically and mechanically connected with an identical connector device when they are aligned along the longitudinal axi and one of them rotated 180 degrees about a transversal axis parallel with the first line, characterised in that the interface part of at least one of the connector devices comprises a second set of electrical contact elements and a third set of electrical contact elements, which second and third sets are symmetrically arranged on opposite sides of the first line in a first plane through the first line, such that for each contact element of the second set there is a corresponding contact element of the third set, which is arranged with equal distance to the first line, and wherein each contact element of the second set is electrically connected to its corresponding contact element of the third set.

BRIEF DESCRIPTION OF THE DRAWINGS

The invention is explained in detail below with reference to the drawing illustrating a preferred embodiment of the invention and in which.

MODES FOR CARRYING OUT THE INVENTION

In the following detailed description, the same reference signs are used for elements, which have similar functions but differ in form and/or number.

Figure 1:
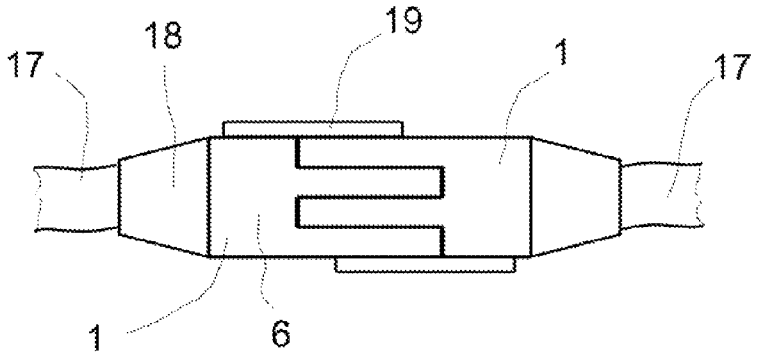
FIG. 1 is a side view of two connected identical genderless connector devices according to the prior art.
Figure 2:
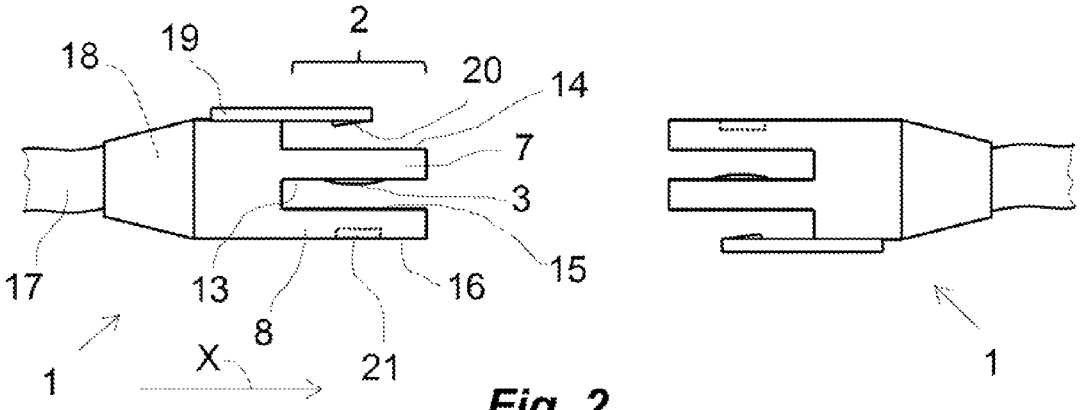
FIG. 2 is a side view of the two connector devices of FIG. 1 in disconnected state.
Figure 3:
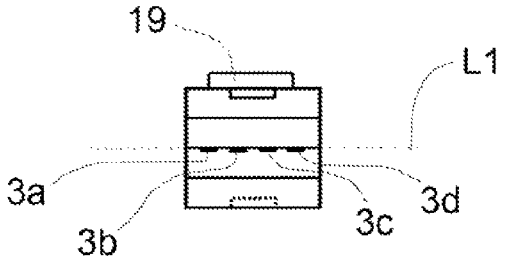
FIG. 3 is a front view of one of the connector devices shown in FIGS. 1 and 2.

FIG. 1 is a side view of two connected identical genderless connector devices 1 according to the prior art, FIG. 2 is a side view of the two connector devices 1 in disconnected state, and FIG. 3 is a front view of one of the connector devices. A genderless electrical connector device 1 as shown in FIGS. 1-3 can be mechanically and electrically connected to an identical connector device 1, which is flipped 180 degrees as shown in FIG. 1. The connector device extends along a longitudinal axis X and comprises a housing 6, an interface part 2 and a strain relieving device 16, from which a cord 1 extends. The strain-relieving device 16 is made of relatively flexible material and prevents breakage of the cord 17 due to sharp bending. The interface part 2 comprises mechanical engagement means in the form of a tongue 7, a bottom part 8 and a leaf member 19, all of which extends in the longitudinal direction (X). A boss member 20 extends inwardly from the leaf member 19 and a recess 21 is provided in the outer side 16 of the bottom part 8. The tongue 7 comprises a first side 13 facing the bottom part 8 and a second side 14 facing the leaf member 19. A first set 3 of four contact elements 3*a*, 3*b*, 3*c*, 3*d* is provided along a line L1 on the first side 13 of the tongue 7. In order to connect the two connector devices 1, one of them must be rotated 180 degrees about an axis parallel to the first line L1. When connected, the tongue 7 of one connector device 1 extends between the bottom part 8 and the leaf member 19 of the other connector device 1, and the boss member 20 one connector device engages the recess 21 of the other connector device 1. During the connection movement, the leaf member 19 flexes away from the bottom member 8 of the other connector device 1, until the boss 20 is received in the recess 21. When connected, the contact elements 3*a*, 3*b*, 3*c*, 3*d* of one connector device 1 is electrically connected the contact elements 3*a*, 3*b*, 3*c*, 3*d* of the other connector device 1, such that the first contact element 3*a* of the first connector device 1 is in electrical contact with the first contact element 3*a* of the other connector device 1, etc. Such connector devices 1 has been used for years for telecommunication devices such as desktop phones and headsets with four wire cords, where the four poles represents microphone+, microphone−, speaker+ and speaker−.

Figure 4:
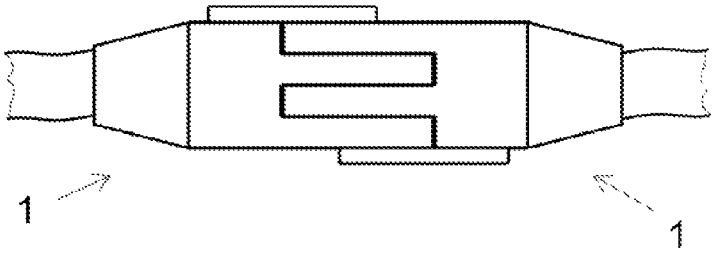
FIG. 4 is a side view of two connected equal genderless connector devices according to a first embodiment of the invention.
Figure 5:
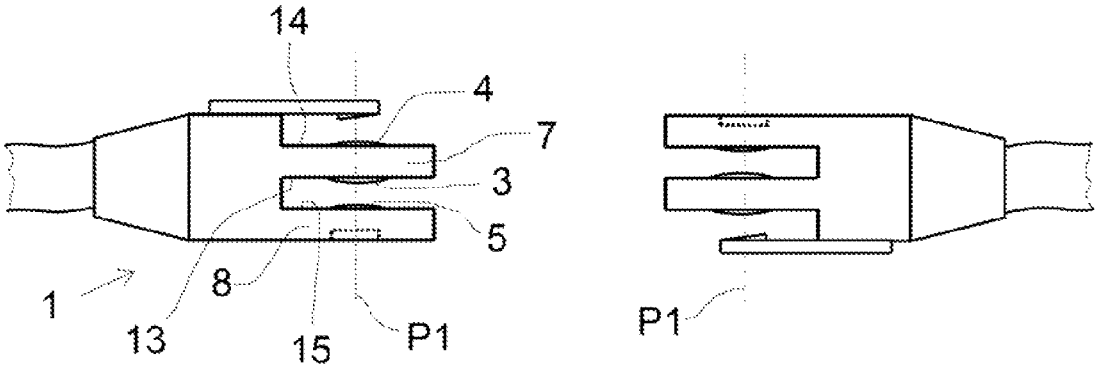
FIG. 5 is a side view of the two connector devices of FIG. 4 in disconnected state.
Figure 6:
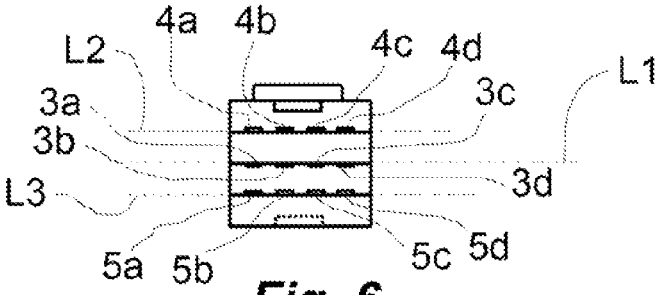
FIG. 6 is a front view of one of the connector devices shown in FIGS. 3 and 4.

FIGS. 4, 5 and 6 disclose a connector device 1 according to a first embodiment of the invention. The connector device 1 comprises a first set 3 of contact elements 3*a*, 3*b*, 3*c*, 3*d* like the prior art connector device 1 shown in FIGS. 1-3. However, the connector device 1 in FIGS. 4-6 also comprise a second set 4 of contact elements 4*a*, 4*b*, 4*c*, 4*d* and a third set 5 of contact elements 5*a*, 5*b*, 5*c*, 5*d*. As shown in FIGS. 5 and 6, the second set 4 is arranged on the second side 14 of the tongue 7, while the third set 5 is arranged on the inner side 15 of the bottom part 8. When the two connector devices 1 are connected, the first contact set 3 of the first connector device 1 will be electrically connected to the first contact set 3 of the other connector device 1 just like the prior art device shown in FIGS. 1-3. However, the second contact set 4 of the first connector device 1 will be electrically connected to the third contact set 5 of the other connector device 1, and the third contact set 5 of the first connector device 1 will be electrically connected to the second contact set 4 of the second connector device 1.

Figure 11:
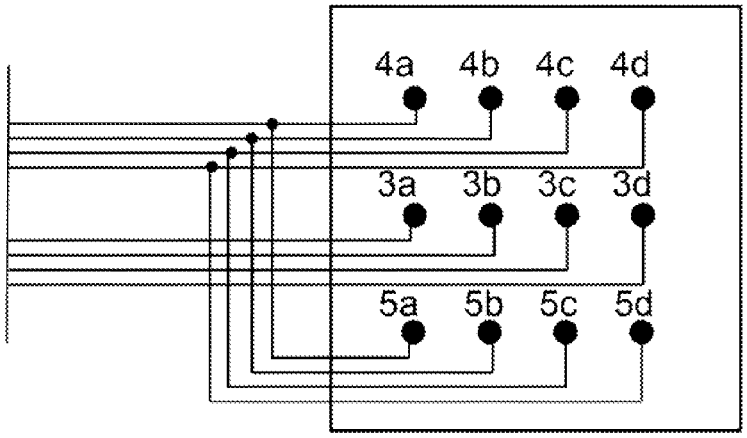
FIG. 11 is a general wiring diagram of a genderless connector according to the invention.

The contact elements 4*a*-4*d* of the second set 4 are internally electrically connected to the contact elements 5*a-d* of the third set 5, which is shown schematically in FIG. 11. Thus, the following applies: the first contact element 4*a* of the second set 4 is electrically connected to the first contact element 5*a* of the third set 5; the second contact element 4*b* of the second set 4 is electrically connected to the second contact element 5*b* of the third set 5; the third contact element 4*c* of the second set 4 is electrically connected to the third contact element 5*c* of the third set 5; and the fourth contact element 4*d* of the second set 4 is electrically connected to the fourth contact element 5*d* of the third set 5.

When connecting two connector devices 1 with eight poles, an eight pole connection is obtained, where the eight poles of one of the connector devices 1 are connected to the eight poles of the other connector device 1. The four extra poles provide further possibilities. When used for telecommunication headsets, the extra poles can be used for an extra speaker (+ and −) and two poles for firmware upgrading. In addition, send and receive the sound as data signals in order to avoid extra steps of analogue-to-digital conversion is a possibility. Off course, other applications are conceivable.

The eight pole genderless connector device 1 is backward compatible with a correspondingly embodied four pole genderless connector device 1.

The second and third contact element sets 4, 5 are symmetrically arranged on opposite sides of the first line L1 in a first plane P1, which extends through the first line L1. For each contact element 4*a-d* of the second set 4, there is a corresponding contact element 5*a-d* of the third set 5, which is arranged with equal distance to the first line L1.

Figure 7:
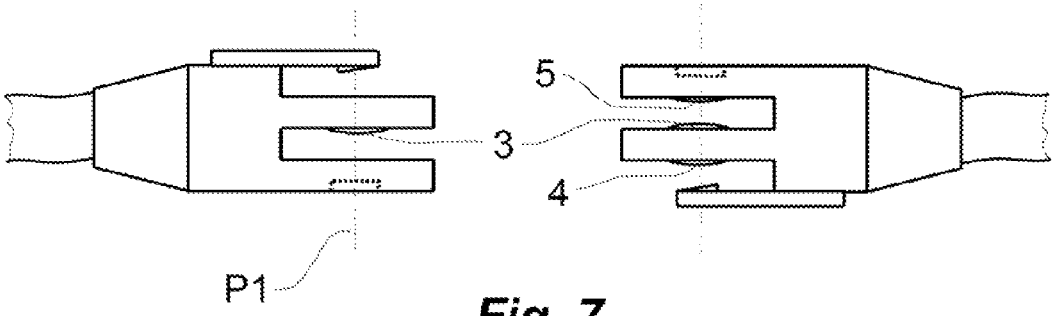
FIG. 7 is a side view of a connector device according to FIGS. 1-3 and a connector device according to FIGS. 4-6.

FIG. 7 discloses to the left a four pole connector device as shown in FIGS. 1-3 and to the right an eight pole connector device 1 as shown in FIGS. 4-6, and which can be connected with each other. The first set 3 of contact elements 3*a-d* of the four pole connector device 1 will be electrically connected with the first set 3 of contact elements 3*a-d* of the eight pole connector device 1. The second and third sets 4, 5 of contact elements 4*a-d*, 5*a-d* of the eight pole connector device 1 will not be electrically connected to any contact elements of the four pole connector device 1.

Figure 8:
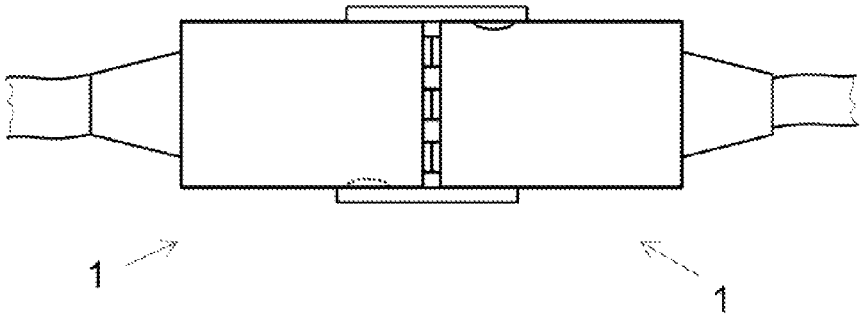
FIG. 8 is a side view of two connected identical genderless connector devices according to a second embodiment of the invention.
Figure 9:
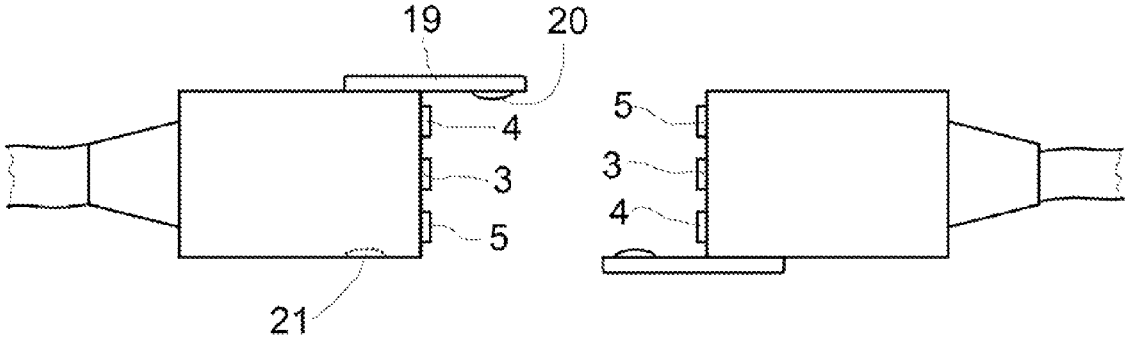
FIG. 9 is a side view of the two connector devices of FIG. 7 in disconnected state.
Figure 10:
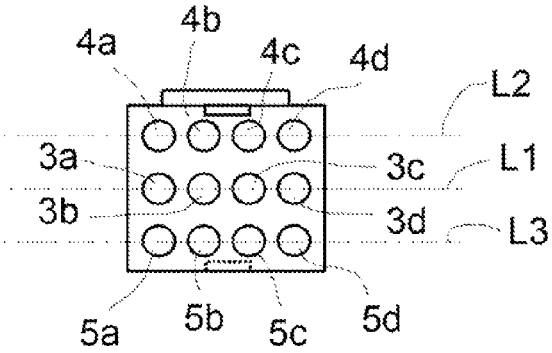
FIG. 10 is a front view of one of the connector devices shown in FIGS. 7 and 8.

FIGS. 8-10 disclose a connector device 1 according to a second embodiment of the invention. Here the first, second and third sets 3, 4, 5 of contact elements are arranged along three parallel lines L1, L2, L3 on a plane front face 23 of the connector device 1.

FIG. 11 is a generic schematic wiring diagram of a connector device 1 according to the invention. Each contact element 4*a-d* of the second set 3 is electrically connected to a corresponding contact element 5*a*-5*d* of the third set 5 on the opposite side of the first set 3.

Figure 12:
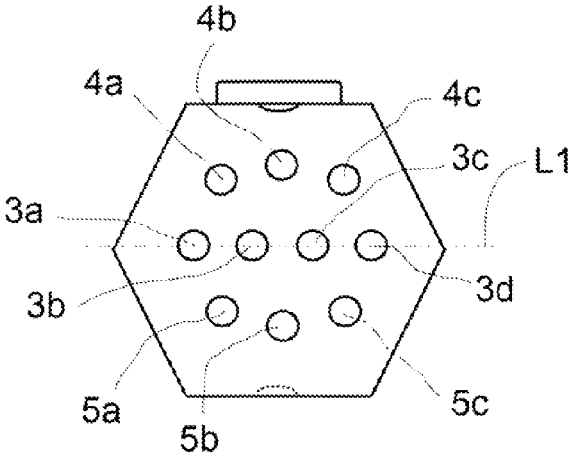
FIG. 12 is a front view of a genderless connector according to a third embodiment of the invention.

FIG. 12 discloses a connector device 1 according to a third embodiment of the invention. The interface part has a hexagonal shape. The first set 3 has four contact elements 3*a*-3*d*, while the second and third sets 4, 5 has only three contact elements 4*a-c*, 5*a-c*. Furthermore, this embodiment differs from foregoing by the contact elements of each of the second and third sets 4, 5 being arranged with different distances to the first line L1. Thus, the second contact element 4*b*, 5*b* of the second and third sets 4, 5 is arranged with greater distance to the first line L1 than the first and third contact element 4*a*, 4*c*, 5*a*, 5*d* of the second and third sets 4, 5. The connector device 1 according to the third embodiment is a seven pole connector device 1.

Figure 13:
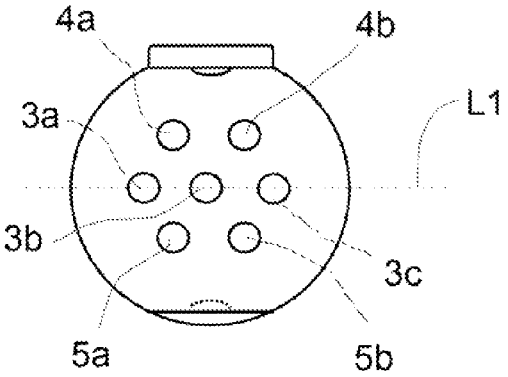
FIG. 13 is a front view of a genderless connector according to a fourth embodiment of the invention.

FIG. 13 discloses a connector device 1 according to a fourth embodiment of the invention. In this embodiment the interface part 2 has a circular cross section and the first set 3 has three contact elements 3*a-c*, while the second and third sets 4, 5 have two contact elements 4*a-b*, 5*a-b*. The connector device according to the third embodiment is a five pole connector device.

Figure 14:
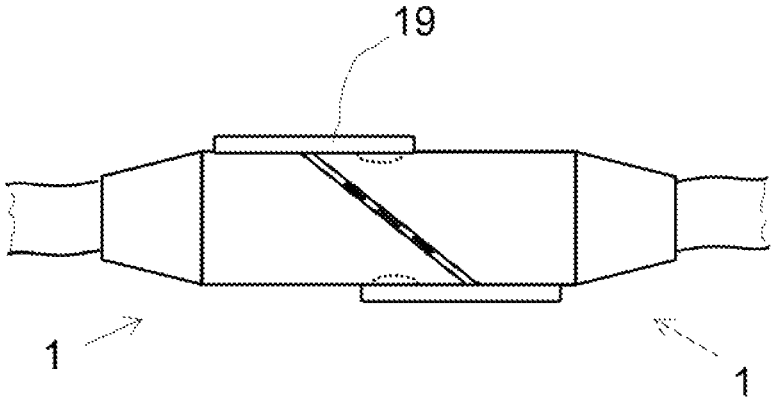
FIG. 14 is a side view of two connected identical genderless connector devices according to a fifth embodiment of the invention.
Figure 15:
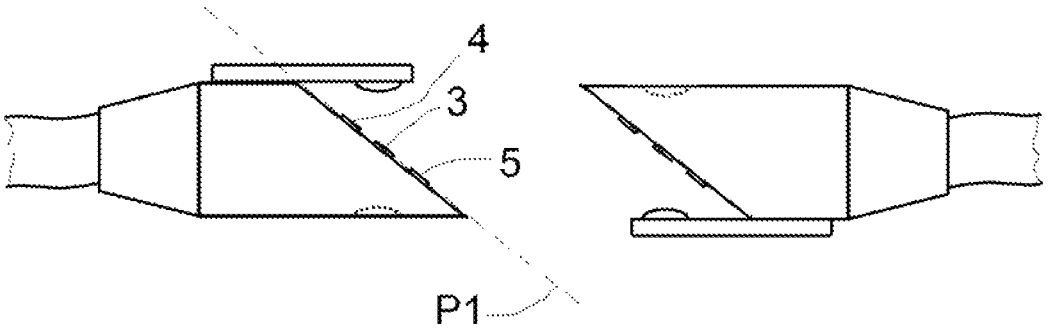
FIG. 15 is a side view of the two connector devices of FIG. 13 in disconnected state.

FIGS. 14 and 15 disclose a connector device according to a fifth embodiment of the invention. Here the three sets 3, 4, 5 of contact elements are arranged in a plane P1, which defines the front face 23 of the connector device 1 and is slanted in relation to the longitudinal axis X.

Figure 16:
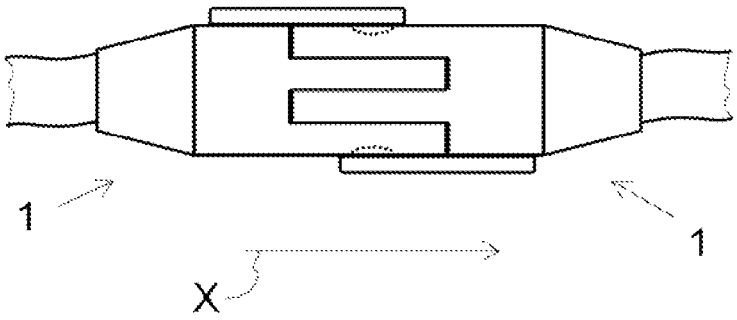
FIG. 16 is a side view of two connected identical genderless connector devices according to a sixth embodiment of the invention.
Figure 17:
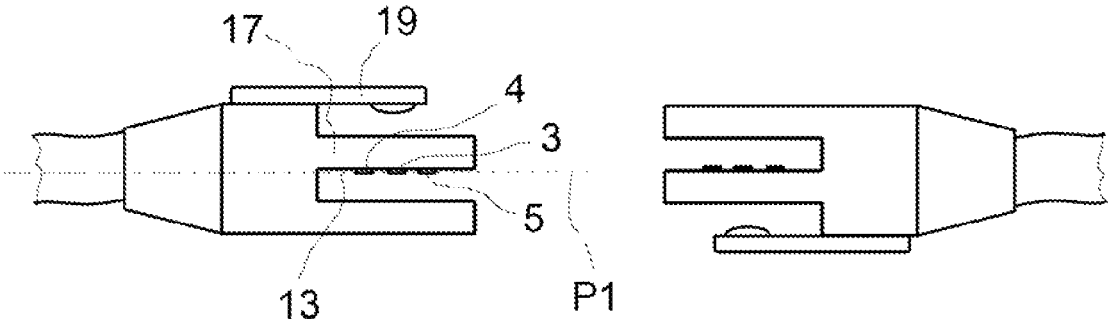
FIG. 17 is a side view of the two connector devices of FIG. 15 in disconnected state.
Figure 18:
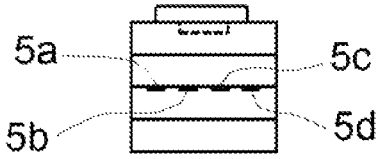
FIG. 18 is a front view of one of the connector devices shown in FIGS. 15 and 16.

FIGS. 16, 17 and 18 disclose a connector device 1 according to a sixth embodiment of the invention. It comprises a tongue 7, a bottom part 8 and a leaf member 19 like the first embodiment, but differs from this by having the first, second and third sets 3, 4, 5 arranged on the first side 13 of the tongue 7 in a plane P1 that extends parallel with the longitudinal axis X. A connector device 1 according to this embodiment can be very compact, as no extra space in the plane of the paper orthogonal to the longitudinal direction X is needed.

Figure 19:
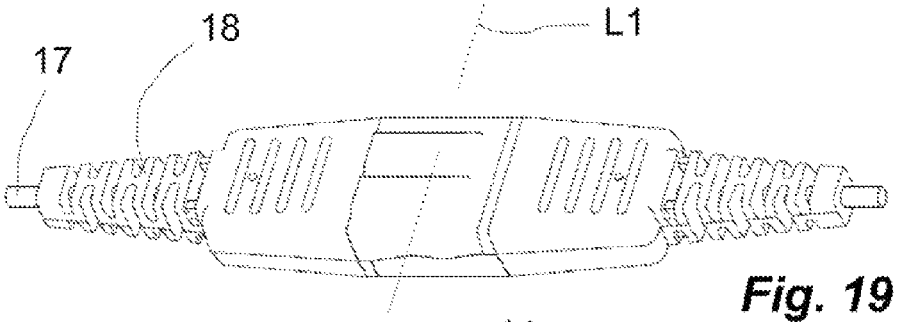
FIG. 19 is a perspective view of two connected identical genderless connector devices according to a seventh embodiment of the invention.
Figure 20:
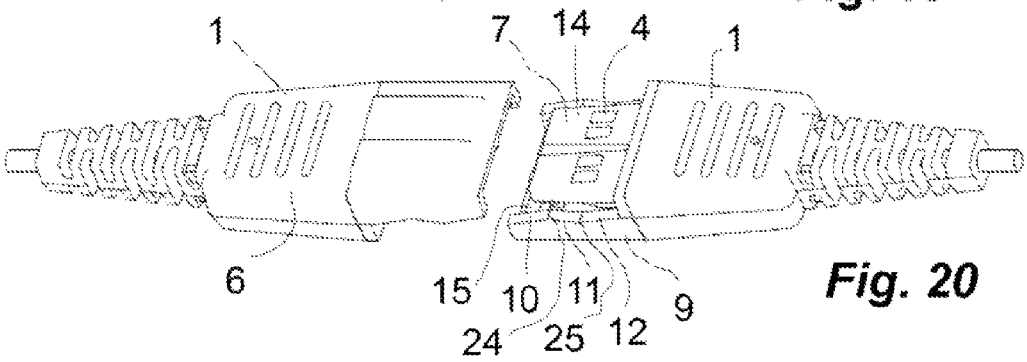
FIG. 20 is a perspective view of the two connector devices of FIG. 18 in disconnected state.
Figure 21:
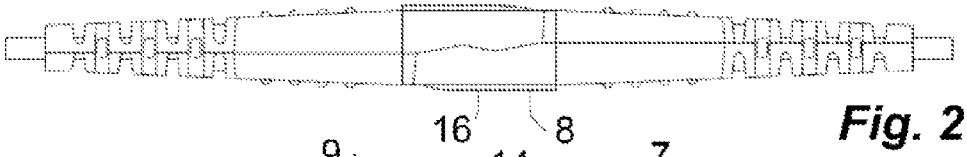
FIG. 21 is a side view of two connected identical genderless connector devices of FIG. 18.
Figure 22:
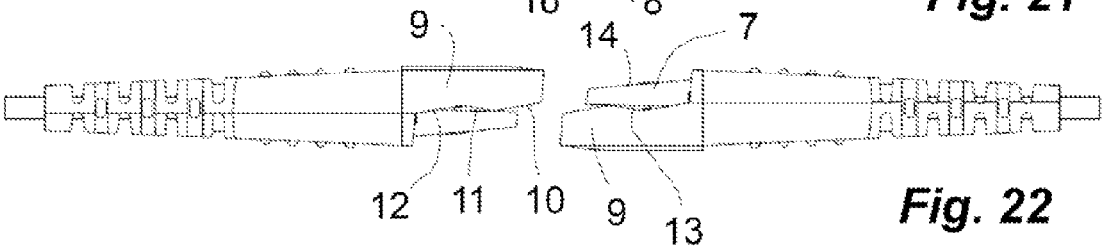
FIG. 22 is a side view of the two connector devices of FIG. 20 ion disconnected state.
Figure 23:
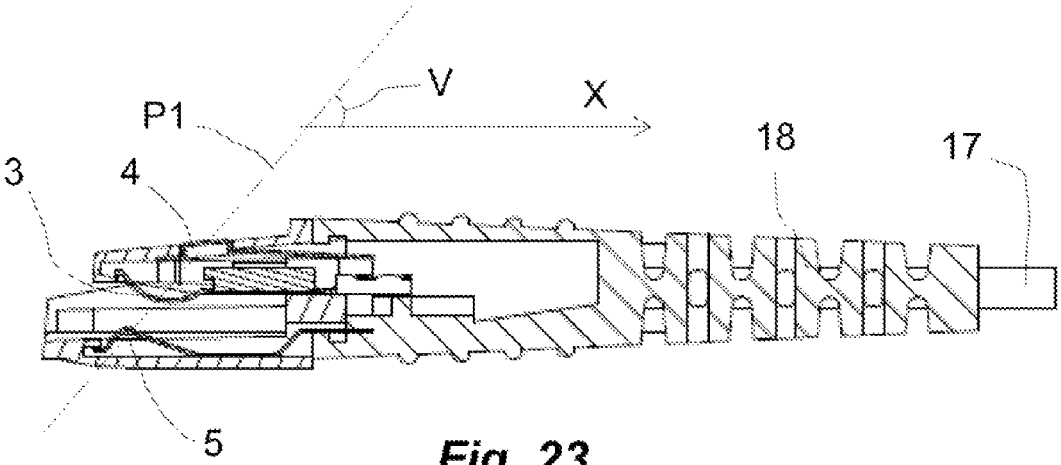
FIG. 23 is a cross sectional view through one of the connector devices shown in FIGS. 18-21.

FIGS. 19, 20, 21, 22 and 23 disclose a connector device 1 according to a seventh embodiment of the invention. Like the first and second embodiments, it comprises a tongue 7 and a bottom part 8. The first set 3 of contact elements is arranged on the first side 13 of the tongue 7. The second set 4 of contact elements is arranged on the second side 14 of the tongue 7. The third set 5 of contact elements is arranged on the inner side 15 of the bottom part 8. Instead of a leaf member, it comprises sidewalls 9 extending from the edges of the bottom part 8. In FIG. 20 to the right it can be seen, that the upper edge of the side wall 9 comprises a first sloping edge part 10, a second sloping edge part 11 and a third sloping edge part 12. The first and second sloping parts 10, 11 define a relatively shallow protrusion 24 and the second and third sloping parts 11, 12 defines a relatively shallow recession 25. When two identical connector devices 1 are connected as shown in FIGS. 19 and 21, the protrusions 24 engages the recessions 25 whereby the connector devices 1 are locked together. FIG. 23 discloses a cross sectional view through the connector device 1 and it can be seen that the three contact sets 3, 4, 5 are lying in a plane P1, which defines an angle V of approximately 50 degrees with the longitudinal axis X. As the Plane P1 is slanted the sets 3, 4, 5 of contact elements are displaced along the longitudinal axis X, whereby less space in the direction orthogonally to the longitudinal direction X and the first line L1 is needed.

When the two connector devices 1 according to the seventh embodiment shown in FIGS. 19-23 are connected, a closure is created by the bottom parts 8 and the side walls 9 about the tongues 7 and sets 3, 4, 5 of contact elements. The material of the housing 6 and interface parts are chosen with a suitable flexibility, so that the connector devices 1 can be connected and disconnected by suitable application of force. The second side 14 of the tongue is sloping a bit in order to make it easier to connect and disconnect the connector devices 1. In order to disconnect the two connector devices 1, the user can simply apply a torque about the first line L1.

The invention is not limited to the embodiments disclosed here. Thus, any number of poles in the first, second and third sets are conceivable. In addition, the connector device could be used for other devices than telecommunication devices.

The electrical contact elements may be embodied as mechanical engagement elements, such that separate mechanical engagement and locking means can be left out.

LIST OF REFERENCE SIGNS

1 electrical connector device
2 interface part
3 first set of electrical contacts
4 second set of electrical contacts
5 third set of electrical contacts
6 connector housing
7 tongue
8 bottom part
9 sidewall

10 first sloping edge part
11 second sloping edge part
12 third sloping edge part
13 first side of tongue
14 second side of tongue
15 inner side of bottom part
16 outer side of bottom part
17 cord
18 strain relieving device
19 leaf member
20 boss member
21 recess
22 chamfer
23 front face of connector device
24 protrusion
25 recess
L1 first line
L2 second line
L3 third line
P1 first plane
V angle between the first plane and longitudinal axis
X longitudinal axis
Y transversal axis

The invention claimed is:

1. An electrical connector device, which extends along a longitudinal axis and having an interface part comprising a first set of electrical contact elements arranged along a first line, which is orthogonal to the longitudinal axis, and mechanical engagement elements being shaped such that the electrical connector device can be electrically and mechanically connected with an identical connector device when they are aligned along the longitudinal axis and one of them rotated 180 degrees about a transversal axis parallel with the first line, wherein the interface part comprises a second set of electrical contact elements and a third set of electrical contact elements, which the second and third sets are symmetrically arranged on opposite sides of the first line in a first plane through the first line, such that for each contact element of the second set there is a corresponding contact element of the third set, which is arranged with equal distance to the first line, and wherein each contact element of the second set is electrically connected to its corresponding contact element of the third set, whereby the second and third sets, via their electrical interconnection, provide backward compatibility to devices having only one of said second or third sets.

2. The electrical connector device according to claim 1, wherein the second set of contact elements is arranged along a second line and the third set of contact elements is arranged along a third line.

3. The electrical connector device according to claim 2, wherein the second line and third line are straight.

4. The electrical connector device according to claim 3, wherein the first, second and third lines are parallel.

5. The electrical connector device according to claim 2, wherein the interface part comprises a tongue extending along the longitudinal axis and comprising a first side and an opposite second side, wherein the first set of contact elements is arranged on the first side and the second set of contact elements is arranged on the second side.

6. The electrical connector device according to claim 5 wherein the interface part comprises a bottom part, which extends parallel with the tongue and comprising an inner side facing the tongue and an opposite outer side, wherein the third set of contact elements is arranged on the inner side of the bottom part.

7. The electrical connector device according to claim 6, wherein the bottom part comprises sidewalls extending from the inner side, such that the bottom parts and side walls of two connected connector devices provides an enclosure around the sets of contact elements.

8. The electrical connector device according to claim 1, wherein the contact elements of each of the second and third sets are arranged with different distances.

9. The electrical connector device according to claim 1, wherein the first plane is lying outside a plane perpendicular to the longitudinal axis.

10. The electrical connector according to claim 9, wherein the angle between the first plane and the longitudinal axis is lying in the range 0-90 degrees, for example between 30-60 degrees.

11. The electrical connector device according to claim 9, wherein the longitudinal axis is lying in the first plane.

12. The electrical connector device according to claim 1, wherein the first set comprise at least two contact elements.

13. The electrical connector device according to claim 12, wherein the first set comprise at least four contact elements.

14. The electrical connector device according to claim 1, wherein each of the second set and third set comprises at least two contact elements.

15. The electrical connector device according to claim 1, wherein each of the second set and third set comprises at least four contact elements.

* * * * *